US005082113A

United States Patent [19]

Romick

[11] Patent Number: 5,082,113

[45] Date of Patent: Jan. 21, 1992

[54] UNIT-DOSE MEDICATION HANDLING AND DISPENSING SYSTEM WITH SIGNALLING TABS AND FLAP

[76] Inventor: Jerome M. Romick, 170 N. Drexel Ave., Columbus, Ohio 43209

[21] Appl. No.: 518,741

[22] Filed: May 2, 1990

[51] Int. Cl.[5] ..... B65D 73/00

[52] U.S. Cl. ..... 206/459; 206/534; 206/539; 40/312

[58] Field of Search ..... 206/459, 534, 538-539; 116/308; 40/312, 313

[56] References Cited

U.S. PATENT DOCUMENTS

| | | | |
|---|---|---|---|
| 3,205,603 | 9/1965 | Brumley | 40/312 |
| 3,497,982 | 3/1970 | Schulz | 40/312 |
| 3,826,222 | 7/1974 | Romick | 116/121 |
| 3,996,879 | 12/1976 | Walton | 116/121 |
| 4,004,691 | 1/1977 | Wihksne | 206/459 |
| 4,472,896 | 9/1984 | Brauner et al. | 40/312 |
| 4,684,023 | 8/1987 | Cortopassi | 206/459 |

FOREIGN PATENT DOCUMENTS

| | | | |
|---|---|---|---|
| 2917626 | 11/1980 | Fed. Rep. of Germany | 206/534 |
| 950173 | 2/1954 | United Kingdom | 206/459 |

*Primary Examiner*—Paul T. Sewell
*Assistant Examiner*—Thomas P. Hilliard
*Attorney, Agent, or Firm*—Wood, Herron & Evans

[57] ABSTRACT

This patent discloses medication dispensing packages that are provided with a plurality of signal tabs to signal when the medication is to be dispensed.

10 Claims, 2 Drawing Sheets

UNIT-DOSE MEDICATION HANDLING AND DISPENSING SYSTEM WITH SIGNALLING TABS AND FLAP

BACKGROUND OF THE INVENTION

In my prior U.S. Pat. No. 3,826,222 there is disclosed a system for handling and dispensing prepackaged unit doses of medicine for a large number of patients, typically long-term nursing home patients. The system, successfully commercialized under the trademark ArtroPak, includes a dispensing box or container that is packed with unit dose medication. The box has printed on its exterior color coded sections to indicate various times and other conditions of administering the unit doses. A label, usually multi-part, printed with indicia relative to the patent is provided for superimposing on the color coded area of the container. By selectively punching the label before it is affixed to the container the color coded sections on the container are exposed when the label is affixed to the container. The exposed coded sections are readily visible to the person dispensing the medication and these color coded indicia signal to the person the time or conditions of administering the medication. Charting records are also provided to indicate the time and conditions of dispensing.

While the medication dispensing system disclosed in my '222 patent has been the standard for the industry for the past 15 years there has developed over that time period a need for an improved system. More particularly, through the years the evolution of computer applications for dispensing medication has resulted in a need for more flexibility in the label format. For example, it is now desirable for the label to accept bar coding and to also accept other information. The label design disclosed in my '222 patent is somewhat restrictive in its configuration for some of these newer applications. Horizontally and vertically disposed labels are now desirable. Also, in many instances, very large, high volume pharmacies have found the selective punching of the label to expose a color coding on the box to be time consuming. In addition, some nursing home facilities require special punching formats that may be difficult to remember. Also, a system is needed where if a mistake is made in setting the dosage administration time it can be easily corrected.

Based upon these and other considerations it has been the principal objectives of this invention:

1. to provide a color-coded system for use in dispensing unit dose medication which does not require a specific cooperating label;
2. to provide such a system which does not require the punching of any label to expose color coding;
3. to provide such a system where the color coding can be easily corrected or changed;
4. to provide such a system which includes a label which can be easily formatted and printed in various ways;
5. to provide such a system which insures that mistakes in dispensing the medication will be minimized.

These and other objectives will be obvious from the following drawings and description.

SUMMARY OF THE INVENTION

Broadly described the present invention comprises a medication dispensing container which includes special, information conveying tabs, hereafter called signal tabs. More particularly printed on the signal tabs is either color coding or other information that assist the nurse in dispensing the medication in the container. Individual colored signal tabs indicate different dosage times. To program the regimen, the non-dosage times are folded back leaving only the desired signal tabs in view. The signal tabs form an easy means to signal the person dispensing the medication as to the proper dosage times. The preferred label used with the container is a removable, pressure sensitive, adhesive label having two printable areas that maybe separated from each other and one removed from the box. One area has color coding. When this portion is removed, for reordering purposes, the absence of the color coding will signal that a reorder has been placed.

The advantages of the present system, in contrast for example to the system shown in my prior art '222 patent are:

1. Color coding is self-contained on the box and does not require a specific cooperating label;
2. Folding back the color signal tabs allows for an easy-to-use "no punching" coding;
3. The coding is easily corrected or changed by folding the signal tabs;
4. The nurse can adjust the signals without pharmacy assistance;
5. The provision of a label which is specially adapted for use in a wide variety of applications and which is adapted for computer use;
6. The plurality of signal tabs eliminates the need to inventory more than one container or additional stickers for coding;
7. The color coding on the label signals when a portion of the label has been removed.

DETAILED DESCRIPTION OF THE INVENTION AND PREFERRED EMBODIMENTS

Figure 1:
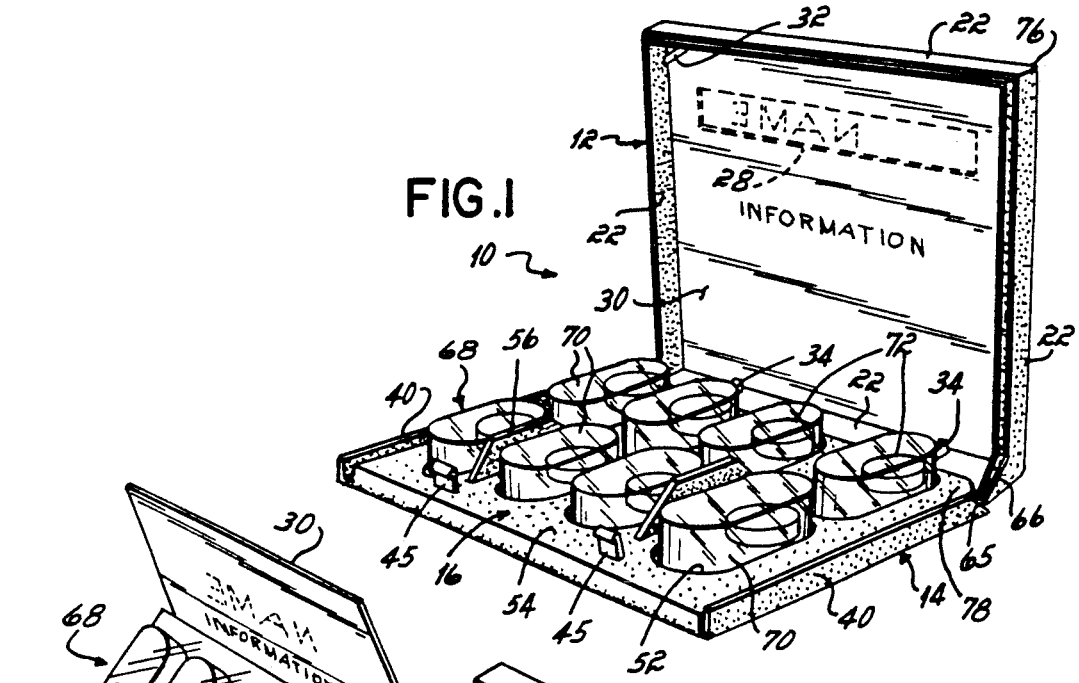
FIG. 1 is an exploded perspective view showing the medication dispenser of the present invention.

Referring to FIG. 1 the medication dispensing container 10 of the present invention is preferably rectangular in configuration and made from cardboard. It has a lid 12 with a score line slit 14 which runs from side to side, approximately in the middle of the lid 12 and perforation 14(*a*). As will be described in more detail later, this permits a portion 16 of the lid to be removed and a portion 18 to remain. Lid 12 includes a depending edge 20 which can fit into the container 10 when it is closed. Alternatively, edge 20 on portion 18 can be positioned over the outside of the container 10 and retained in slit 22 in the side 24 of the container 10. The container 10 is designed to receive and to store medication, not shown, preferably in unit dose form.

Figure 2:
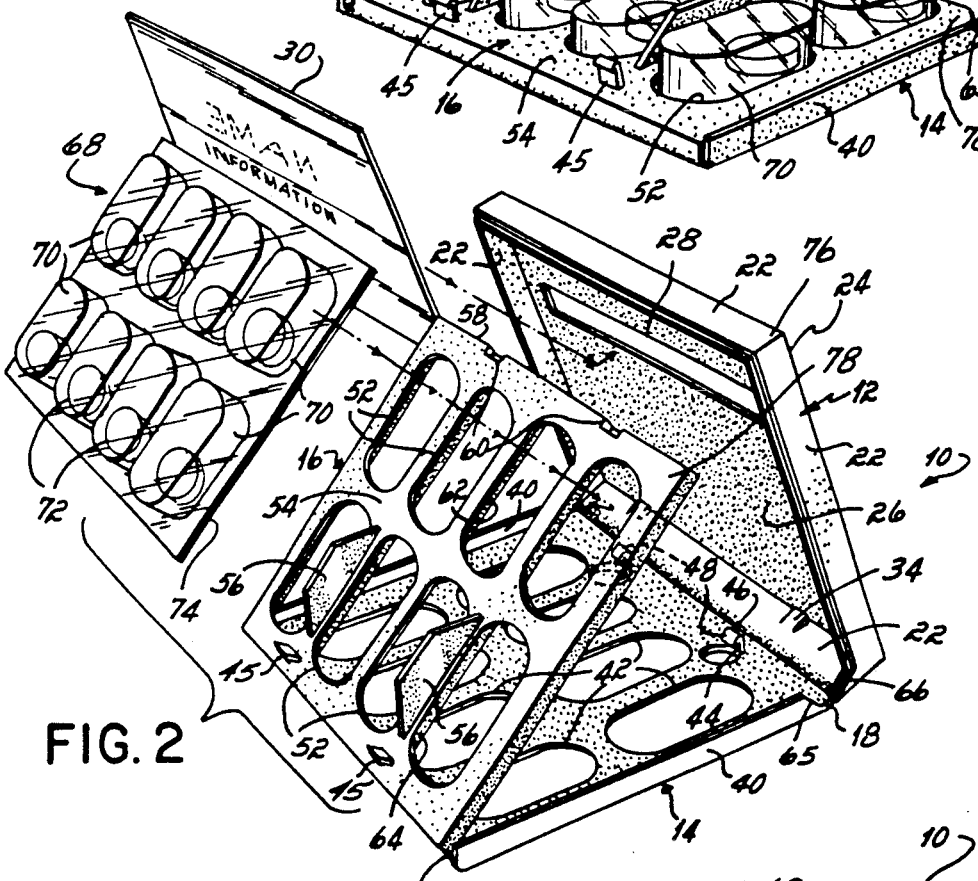
FIG. 2 shows a portion of the container of FIG. 1 with some signal tabs bent to positions below the lid.
Figure 3:
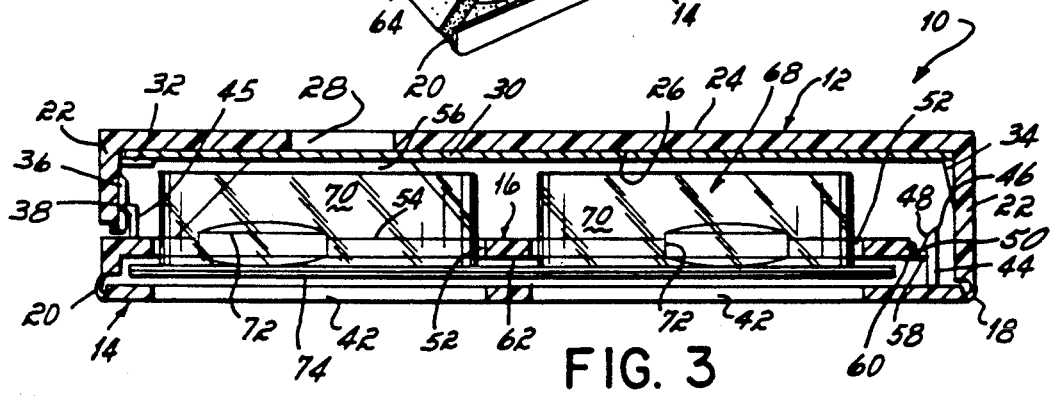
FIG. 3 shows a portion of the container with the "Check Med Sheet" flap covering the signal tabs.

Attached to ends 26 of the container are flaps 28 and 30. One flap 30 has imprinted thereon "Check Med Sheet." As will be more fully described later, it serves an important signalling function to the person dispensing medication. The portion 18 of the lid 12 has at an upper edge 32 a plurality of signal tabs 34 that assist in dispensing medication. In the form shown there are 6 signal tabs 34 which are separable from the lid 12 by reason of slits 36 and score line 36(*a*). As shown they have color coded circles 40 and printing of AM, Noon, etc. These legends signify dispensing times. The color coded circles 40, in different colors, assist in signalling when dosages must be administered. The color coding circles 40 are the preferred signalling means but lettering or designs could be used. The slit 36 permit individual signal tabs 34 to be removed or bent on score line 36(*a*). When bent they can be moved to position below the lid 12 (See FIG. 2). The purpose of doing either is to provide a means, along with a patient medication sheet, not shown, to signal when medication is to be dispensed. To signal the proper dispensing times, the undesired signal tabs 34 are removed or they are bent to a position below the lid 12. In FIG. 1 they are shown in a signalling position. In FIG. 2 all of the signal tabs 34 except for the "PRN" signal tab 34 are in the non-signalling position. As used herein when it is said that signal tabs 34 may be positioned in a signalling or non-signalling position it is meant that they can be so positioned by bending or tearing away. As shown the signal tabs 34 are on the upper edge 32 of the lid 12 but they could be provided at other locations. Alternatively, they could be associated with the flaps 28 or 30.

Figure 4:
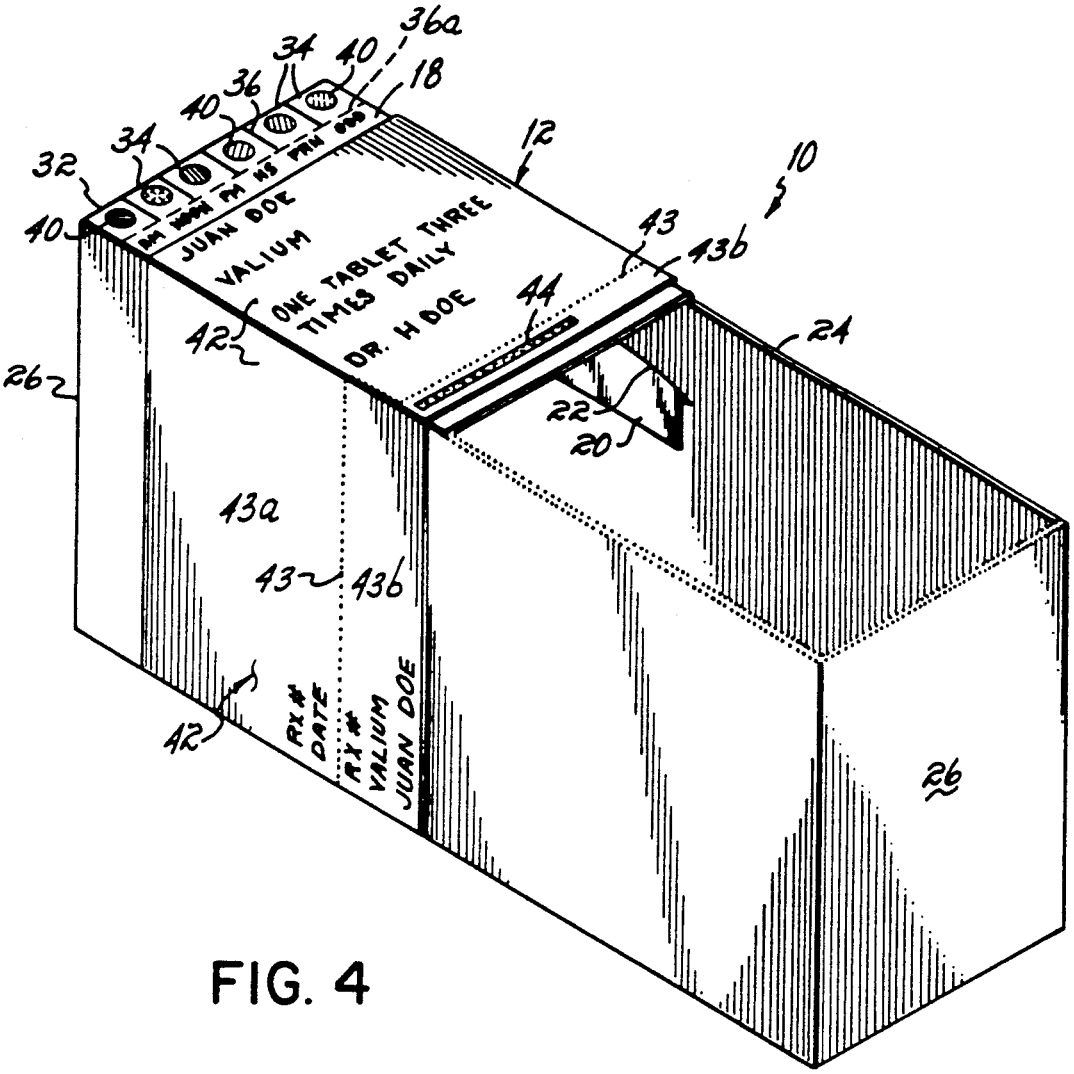
FIG. 4 is a perspective view showing a label of the present invention.

As shown in FIG. 4 the label 42 (not shown) is a one-layer label with pressure sensitive adhesive applied to the back side. The size of the label 42 permits it to cover the top and side of the container 10. A score line 43 separates it into two printable areas 43(*a*) and 43(*b*). Area 43(*a*) would be viewable by the person administering medication, area 43(*b*) would not be. The purpose of area 43(*b*) is to provide an area for recording patient drug information so that when removed it can inform the pharmacist that the prescription must be refilled. More particularly, when a refill is needed the area 43(*b*) is removed from the container 10 and sent to the pharmacist to indicate that the prescription must be refilled. Provided on area 43(*b*) is a color coded line 44. This line 44 is located on area 43(*b*) at a position which insures that it will be on the top surface of the container 10 when the label 42 is affixed thereto. The use of the color coded line 44 provides a way to signal when the medication has been reordered. More particularly, when multiple containers 10 are placed in a tray, not shown, only the top surfaces of the containers 10 are visible. The absence of the color coded line 44 signals that portion 43(*b*) has been removed and returned to the pharmacist.

As to the patient drug information that is recorded on area 43(*a*), it is preferred that the information be imprinted adjacent to the signal tabs 34 (see FIG. 4). By doing so, the information covered and obscured by folding the check med sheet flap 30 so that it is on the outside of the container 10, thus covering the information. Doing this instructs the nurse that the printed instructions are to be ignored and the med sheet reviewed for the valid instructions.

End 26 of the container 10 can advantageously also be color coded. The purpose of this is to indicate to the pharmacist which containers have been filled. If a container 10 is positioned so that the color coding is visible, that signals they are full.

In use, the container 10 may be used with patient trays and carts and cassettes of the type shown in U.S. Pat. No. 4,616,890.

While the invention has been described in context with a container 10 having four walls, a top and a bottom, the invention also contemplates placing the tabs 34 on a cardboard sleeve, not shown, that would slide around a dispensing container, such as is shown in U.S. Pat. No. 4,418,823.

In use the medication dispensing container 10 of the present invention is filled by a pharmacist with the desired medication. Generally, this will be unit doses. The label 42 is printed, either by computer or by other means, with the desired patient, drug dosage, etc. information and is affixed to the lid 12 immediately below the signal tabs 34. The pharmacist also fills out the patient's medication form sheet so that the person dispensing the medication knows the proper times for the medication to be administered. To assist in administering the mediation at the proper time the pharmacist either removes the undesired signal tabs 34 by tearing them away or bends them so that they lie below the lid 12. The lid 12 is closed and the medication placed in appropriate carts, patient trays or the like and sent to the place where the medication is to be dispensed, usually a long term care nursing home. If the pharmacist has chosen to bend the signal tabs 34, the check med sheet flap 30 and the unit doses operate to hold the signal tabs 34 beneath and against the bottom of lid 12. The person dispensing the medication, usually a nurse, removes portion 16 of the lid 12 and places the depending edge 20 of the remaining portion 18 of the lid into the slit 22 in the side 24 of the container 10. As the nurse begins dispensing medication the signal tabs 34 are used, in association with medication charts, to signal the appropriate dispensing time.

Figure 5:
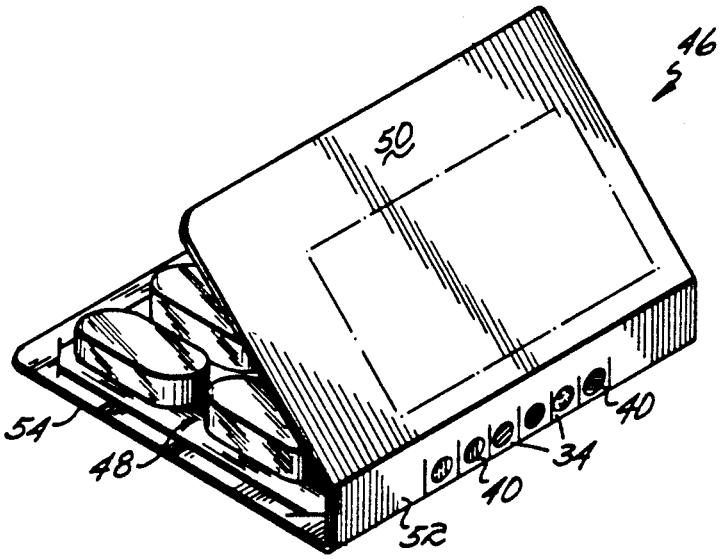
FIG. 5 is an alternative form of the present invention.
Figure 1:
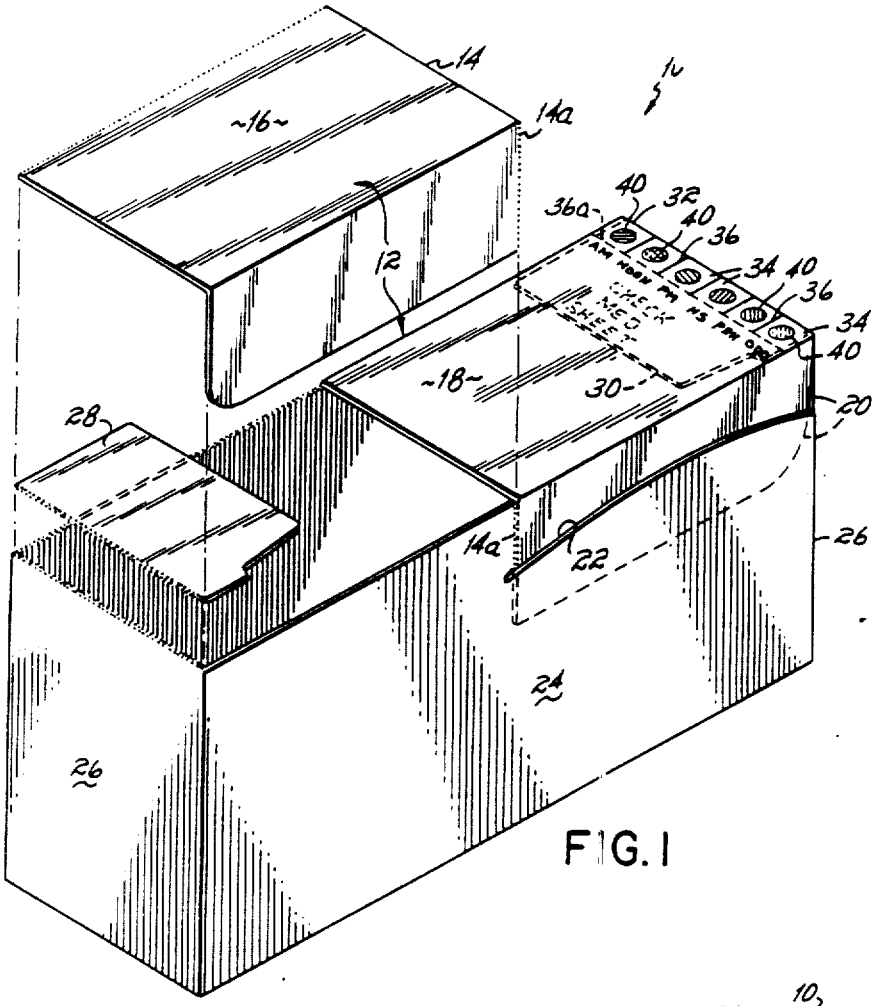
Figure 2:
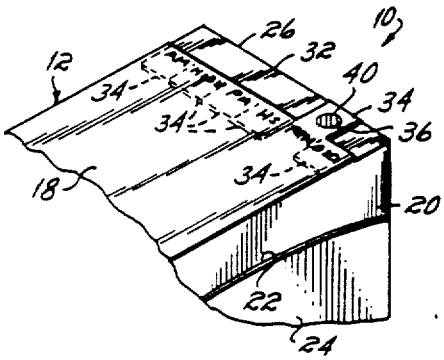
Figure 3:
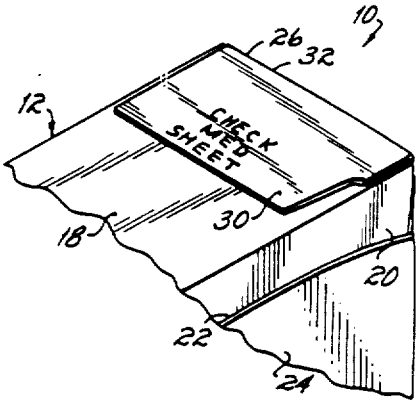
Figure 4:
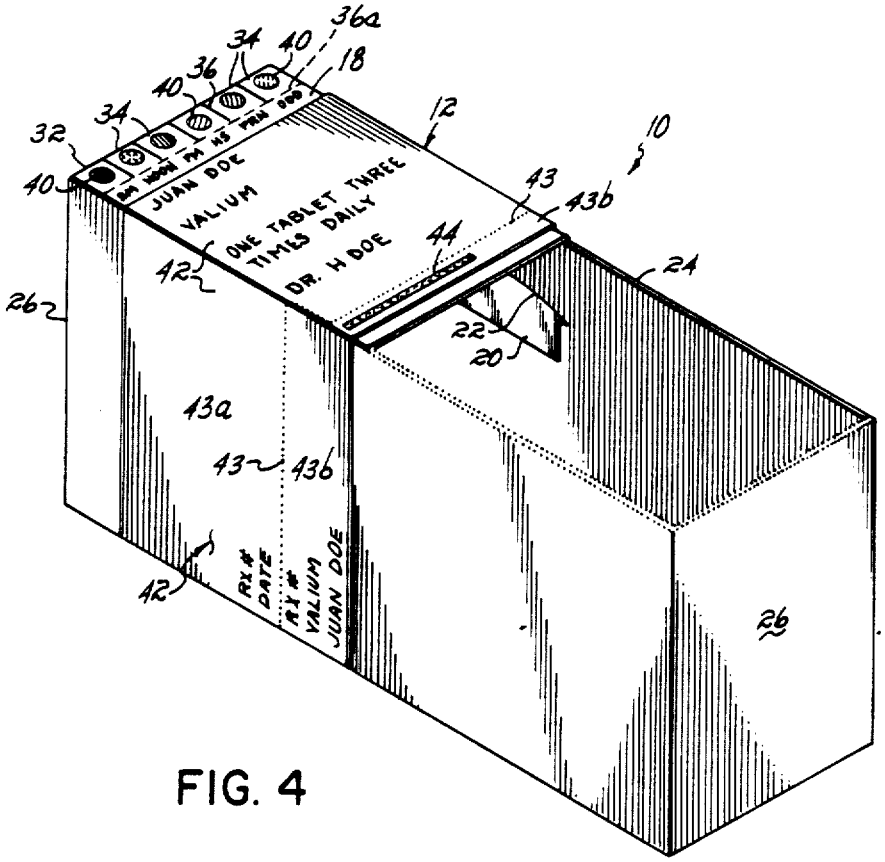
Figure 5:
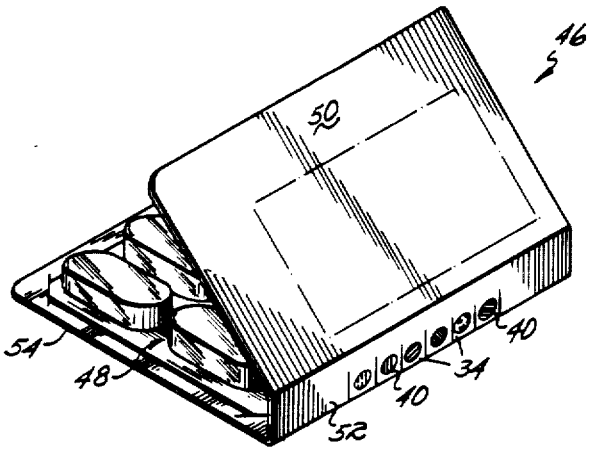

FIG. 5 shows an alternative form, i.e. packet, of the present invention with signal tabs 34. In this embodiment the medication is packaged in blisters 48 made from plastic with foil bottoms sealing the blisters, not shown, in a conventional manner. The packet 46 is disposable after useage, being made from cardboard. It has a front 50, and edge 52 and a back 54. The back 54 has holes therein, not shown, which permit a pill in a blister 48 to be punched through the foil and through the hole in the back 54 so that it is available for useage. The signal tabs 34 are made and used in the same manner as in the system heretofore described.

Having thus described my invention, I claim:

1. A dispensing package for dispensing medication, comprising:

a dispensing container for housing a supply of medication having at least a first and second wall, with each wall having a top edge;

said lid having a perforated line which runs across said lid, separating said lid into one section with and one section without said tabs;

whereby the section of said lid without said tabs is removable from said container allowing unrestricted access to a supply of medication;

a lid having a plurality of edges, wherein one lid edge is integrally joined to the first wall top edge;

a plurality of tabs having signalling indicia displayed thereon and being formed from said lid, wherein each tab is bordered by a lid edge length and two spaced apart perforated lines that extend from the bordering length of lid edge, whereby each tab is positionable, at the point where said lines end, from a signalling to a non-signalling position by being bent to lie below said lid or removed from said lid, such that when said tabs are in the signalling position, the signalling indicia is visible, and when said tabs are in the non-signalling position, said tabs are no longer visible;

at least one flap having an edge integrally joined to the second wall top edge, whereby said flap can be bent to lie below said lid to assist in maintaining the non-signalling position of bent tabs and said flap can be bent to lie over said signalling tabs to block the indicia from view; and a label receiving area located on said lid, adjacent to said tabs.

2. The package of claim 1 further comprising a label affixed to said label receiving area, wherein said label has an information receiving area which is positioned adjacent to said tabs such that said flap can be bent so as to overlay at least part of the information receiving area, whereby medical information printed on said information receiving area can be blocked from view by said flap, thus providing predetermined instruction to the person dispensing the medication.

3. The package of claim 2 wherein said label is separated into a portion with and without a color coding thereon, said color coded portion being removable in order to signal the medication dispensing person that predetermined instructions should be followed.

4. The package of claim 1 wherein the signalling indicia displayed on said tabs is color coded; and there is a legend, corresponding to each indicia, printed on a portion of said lid located adjacent to each tab, wherein each legend remains viewable when said tabs are in a non-signalling position.

5. A medication dispensing package, comprising:

a package for receiving a supply of medication having at least one surface, with said surface having a plurality of edges;

a plurality of tabs formed from a portion of said surface, wherein each tab is bordered by an edge length and two spaced apart perforated lines that extend from the bordering edge length, and each tab has signalling indicia displayed thereon, with a legend corresponding to each indicia printed on a portion of said surface located adjacent to each tab, whereby each signal tab is positionable, at the point where said lines end, from a signalling to a non-signalling position such that when said tabs are in the signalling position, the indicia and legends are visible, and when said tabs are in the non-signalling position, only the legends are visible;

a label receiving area located on said surface and adjacent to said tabs;

a flap formed from a portion of said surface bounded by a folded and a free edge and located such that said flap can be bent along the folded edge to overlie said signal tabs, legends and a portion of said label receiving area.

6. The package of claim 5 further comprising a label affixed to said label receiving area.

7. The package of claim 6 wherein the signalling indicia on said tabs is color coded and the label has color coding to signal the removal of a portion thereof.

8. The package of claim 5 wherein each tab is positionable from a signalling to a non-signalling position by being bent to lie below said surface.

9. The package of claim 5 wherein each tab is positionable from a signalling to a non-signalling position by being removed from said surface.

10. The package of claim 5 wherein the signalling indicia displayed on said tabs is color coded.

* * * * *

UNITED STATES PATENT AND TRADEMARK OFFICE

CERTIFICATE OF CORRECTION

PATENT NO. : 5,082,113

DATED : January 21, 1992

INVENTOR(S) : Jerome M. Romick

It is certified that error appears in the above-identified patent and that said Letters Patent is hereby corrected as shown below:

The title page showing the illustrative figures should be deleted and replaced with the attached title page.

Signed and Sealed this

Twenty-sixth Day of May, 1992

*Attest:*

DOUGLAS B. COMER

*Attesting Officer*

*Acting Commissioner of Patents and Trademarks*

US005082113A

United States Patent [19]

Romick

[11] Patent Number: 5,082,113

[45] Date of Patent: Jan. 21, 1992

[54] UNIT-DOSE MEDICATION HANDLING AND DISPENSING SYSTEM WITH SIGNALLING TABS AND FLAP

[76] Inventor: Jerome M. Romick, 170 N. Drexel Ave., Columbus, Ohio 43209

[21] Appl. No.: 518,741

[22] Filed: May 2, 1990

[51] Int. Cl.[5] ..... B65D 73/00

[52] U.S. Cl. ..... 206/459; 206/534; 206/539; 40/312

[58] Field of Search ..... 206/459, 534, 538–539; 116/308; 40/312, 313

[56] References Cited

U.S. PATENT DOCUMENTS

| | | | |
|---|---|---|---|
| 3,205,603 | 9/1965 | Brumley | 40/312 |
| 3,497,982 | 3/1970 | Schulz | 40/312 |
| 3,826,222 | 7/1974 | Romick | 116/121 |
| 3,996,879 | 12/1976 | Walton | 116/121 |
| 4,004,691 | 1/1977 | Wihksne | 206/459 |
| 4,472,896 | 9/1984 | Brauner et al. | 40/312 |
| 4,684,023 | 8/1987 | Cortopassi | 206/459 |

FOREIGN PATENT DOCUMENTS

| | | | |
|---|---|---|---|
| 2917626 | 11/1980 | Fed. Rep. of Germany | 206/534 |
| 950173 | 2/1954 | United Kingdom | 206/459 |

*Primary Examiner*—Paul T. Sewell
*Assistant Examiner*—Thomas P. Hilliard
*Attorney, Agent, or Firm*—Wood, Herron & Evans

[57] ABSTRACT

This patent discloses medication dispensing packages that are provided with a plurality of signal tabs to signal when the medication is to be dispensed.

10 Claims, 2 Drawing Sheets

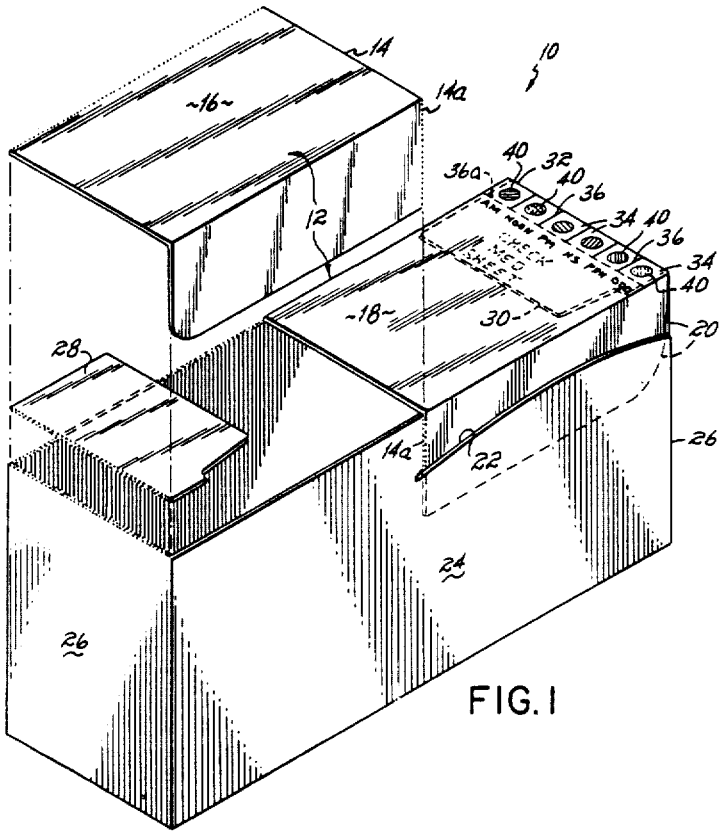

FIG. 1